US005597116A

United States Patent [19]

Morris

[11] Patent Number: 5,597,116

[45] Date of Patent: Jan. 28, 1997

[54] TOP OPENING LOCKING MAILBOX

[76] Inventor: Glenn Morris, 8080 Banks Mill Rd., Douglasville, Ga. 30135

[21] Appl. No.: 340,217

[22] Filed: Nov. 16, 1994

[51] Int. Cl.[6] ..... A47G 29/12

[52] U.S. Cl. ..... 232/20; 232/27

[58] Field of Search ..... 232/17, 19, 20, 232/27, 28, 29, 38

[56] References Cited

U.S. PATENT DOCUMENTS

| | | | |
|---|---|---|---|
| 488,419 | 12/1892 | Blakeney | 232/20 |
| 584,137 | 6/1897 | Willinger et al. | 232/17 |
| 1,014,508 | 1/1912 | Ohlson | 232/17 |
| 1,520,544 | 12/1924 | Mezei | 232/1 A |
| 2,194,226 | 3/1940 | Holdren | 232/19 |
| 2,507,785 | 5/1950 | Hartman | 232/19 |
| 2,532,134 | 11/1950 | Wiedman | 232/19 |
| 2,578,692 | 12/1951 | Gieseler | 232/19 |
| 2,604,260 | 7/1952 | Brown | 232/19 |
| 3,401,875 | 9/1968 | Bruhns | 232/34 |
| 3,502,261 | 3/1970 | Solis | 232/33 |
| 3,735,919 | 5/1973 | Morgan | 232/17 |
| 3,749,302 | 7/1973 | White | 232/19 |
| 3,758,027 | 9/1973 | Morgan | 232/17 |
| 3,880,344 | 4/1975 | Earle | 232/17 |
| 4,357,898 | 11/1982 | Fehrenbacher | 118/504 |
| 4,398,495 | 8/1983 | Harris, Jr. et al. | 118/504 |
| 4,449,267 | 5/1984 | Siemion | 15/257 |
| 4,724,999 | 2/1988 | Fitzgerald et al. | 232/17 |
| 4,993,626 | 2/1991 | Berry | 232/17 |
| 5,000,378 | 3/1991 | Dorr et al. | 232/17 |
| 5,001,865 | 3/1991 | Procton | 49/469 |
| 5,071,063 | 12/1991 | Overstreet | 232/17 |
| 5,096,115 | 3/1992 | Hassan | 232/17 |
| 5,230,181 | 7/1993 | Geoffrey et al. | 49/469 |
| 5,230,738 | 7/1993 | Wheeler | 118/504 |
| 5,283,977 | 2/1994 | Smith | 49/380 |

OTHER PUBLICATIONS

Step 2 catalog excerpts (3 pages).
Lawn and Garden Catalog Excerpt (1 Page).

*Primary Examiner*—Michael J. Milano
*Attorney, Agent, or Firm*—Isaf, Vaughan & Kerr; Charles H. Fails

[57] ABSTRACT

A top opening locking mailbox (5) for receiving mail and other deliveries, to include newspapers and magazines, in a weather and theft resistant housing (7) having a top panel (22) pivotally supported on the top of housing (7), the top panel being movable from an open to a closed position. Top panel (22) is locked onto the housing by a locking mechanism (26) in a closed position on top of housing (7), forming a first enclosed compartment (9) for the receipt of mail and other deliveries. A second and external compartment (10) is mounted on the exterior of housing (7), second compartment (10) holding mail for pickup. Top panel (22) extends beyond front panel (14) of housing (7), forming a protective lip (56) for sheltering mail slot (34) defined in the front panel. Mail slot (34) extends the width of front panel (14) and is enclosed by a flap (36) which is pivotally supported on the inside of the housing within first compartment (9). Top panel (22) is sealed on the top horizontal edges of housing (7).

19 Claims, 2 Drawing Sheets

TOP OPENING LOCKING MAILBOX

FIELD OF THE INVENTION

This invention relates in general to mailboxes. More particularly, this invention relates to a top opening locking mailbox having two separate compartments, one enclosed by housing for receiving mail and other deliveries in a secure and weather resistant enclosure, and a second compartment mounted externally on the housing for holding outgoing mail.

BACKGROUND OF THE INVENTION

Mailboxes are known in the art. In rural and suburban environments mailboxes by the side of the street are a common phenomenon. Street side mailboxes serve two important and primary purposes, the first of which is to receive mail and other deliveries, to include newspapers, magazines, and like, and the second of which is to provide a deposit point for outgoing mail and parcels for pick up by the letter carrier as he or she makes their rounds.

Although federal laws exist that punish the theft of mail, problems with theft of mail, particularly financial documents such as social security, retirement, and pension checks, as well as financial statements to include bank documents and credit cards, exist. Suburban and rural mailboxes are also subject to vandalism and destruction, to include the placement of explosive devices inside mailboxes by those bent on acts of mischief and vandalism.

A number of approaches have been taken in the attempt to provide a secure and accessible mailbox, while also preventing the theft of mail and other deliveries held inside the mailbox. One of these mailboxes is disclosed in the patent to Berry, U.S. Pat. No. 4,993,626, disclosing a security mailbox for the storage of mail in a secure lower portion of a housing, the mailbox having a pivoting mail shelf to divide the housing into upper and lower compartments with the mail shelf being moved from a substantially horizontal rest position to a downwardly inclined main dump position. In Berry, however, the mailbox housing has only a single compartment defined therein, into which not only mail, but other objects, such as, for example, explosive devices for the purposes of vandalism, can be inserted into the mailbox.

Similarly, the secured mailbox of Fitzgerald et al. U.S. Pat. No. 4,724,999, discloses a mailbox or receptacle for mail which has two compartments in communication with each other, an unsecured upper compartment and a locked lower compartment with a movable partition between the two compartments. In Fitzgerald et al., an opening in the partition accesses a chute extending downwardly from the upper compartment into the lower compartment, the chute being set at an angle which allows mail and papers to pass from the upper to the lower compartment.

The patent to Overstreet, U.S. Pat. No. 5,071,063, is similar to the patents to Berry and Fitzgerald in that it discloses a housing having a mail delivery door through which mail is placed into the housing and passed downwardly into the bottom of the housing. However, Overstreet has only a single, or common compartment, defined in the housing of the mailbox.

Another approach taken to deal with the problem of protecting mail is shown in the patents to Bruhns, U.S. Pat. No. 3,401,875, Morgan, U.S. Pat. No. 3,735,919, and Morgan, U.S. Pat. No. 3,758,027. In each of these three patents a mailbox having upper and lower compartments is disclosed, where a trap door mechanism separates the upper compartment from the lower compartment so that once mail is placed into the upper compartment and the actuating mechanism is operated by the closing of the mail delivery door or other means, a trap door opens, and the mail passes into a lower compartment. However, and like the mailboxes of Berry, Fitzgerald et al., and Overstreet, once a package or other delivery is placed in the mailbox, to include unauthorized deliveries placed in the mailbox, the opening of the trap door passes the articles into the lower compartment. Also, and due to the nature of their construction, the mailboxes to Bruhns and Morgan are relatively complicated in nature, having a number of mechanical parts interlinked and operated upon opening of the mailbox door or through the use of an actuating mechanism, the mechanisms thus being subject to wear.

None of the prior art known to the inventor discloses or illustrates a top opening locking mailbox having two separate compartments, a first compartment enclosed within the housing forming the mailbox for receiving mail and other authorized deliveries, and a second compartment mounted externally on the housing for holding outgoing mail, where there is not a passage between the outgoing mail compartment and the mail receiving compartment, where there is no actuating mechanism needed to enable a support mechanism to hold mail awaiting pickup, and which does not permit mail to be passed through the external compartment into the internal compartment. Thus, the need exists for an improved and simple locking mailbox which is adapted to house mail and authorized deliveries in a secured, locked, weather and theft resistant enclosure sized large enough to allow mail to accumulate over a period of time, as well as holding outgoing mail without the use of an operating mechanism, nor provide access to the secured and enclosed compartment holding the delivered mail.

SUMMARY OF THE INVENTION

The present invention provides an improved top opening locking mailbox which overcomes some of the design deficiencies of other locking mailboxes known in the art by providing a mailbox having a generally rectangular housing enclosing a first compartment, the housing have a closed bottom and closed sides, with an open top, and a top panel spaced apart from the closed bottom and supported on the housing of the housing, the top panel being movable from an open position into a locked and closed position on the housing.

The top opening locking mailbox is provided with a lock mechanism, either a cylinder lock or a hasp and a padlock, for locking the top panel in its closed position on the housing to thus enclose the first enclosed compartment in the housing. An elongated mail slot is defined in the housing for passing mail and deliveries into the first compartment, the mail slot extending the width of the housing. An elongated mail flap is mounted pivotally inside the housing and is sized and shaped to close over and on the mail slot. The flap is biased in a closed position on the slot, and is sized and shaped to be yieldably urged open as mail and deliveries are passed through the slot into the enclosed compartment.

The top opening locking mailbox has a second compartment mounted externally on the housing, the second compartment having at least one opening defined therein for holding outgoing mail to be picked up by a letter carrier. Thus, outgoing mail is placed in the second compartment for pick up, and mail and deliveries are passed through the mail slot into the first compartment by the letter carrier and held within the first compartment until the top panel of the mailbox is unlocked by an authorized person and the contents of the compartment removed.

Thus, it is an object of this invention to provide an improved mailbox which has an enclosed first compartment opened through the top of the compartment for the removal of mail and other deliveries.

It is a further object of this invention to provide a mailbox from which the contents of the mailbox can be removed by a person standing next to the mailbox rather than in front of the mailbox and in the street along which the mailbox is installed.

An additional object of the current invention is to provide a mailbox which is sized and shaped to receive mail and deliveries, but which is resistant to theft, vandalism, and or the destruction of mail and deliveries housed within.

Another object of the invention is to provide a mailbox that has a secured, locked storage compartment in which the mail deposited therein is held out of sight and out of reach from outside the mailbox, yet which does not require a key or the actuation of a mechanism by a delivery person to deposit mail or other items therein.

A further object of the invention is to provide a mailbox that can be used as a conventional mailbox for sending and receiving mail in a conventional manner if so desired.

Another object of the invention is to provide a mailbox which will totally enclose and house mail and deliveries passed into the mailbox within a weather resistant enclosure to protect the mail and deliveries from the elements.

Still another object of this invention is to provide a locking mailbox which is easy and inexpensive to construct, is durable and rugged in structure, and is easy to maintain.

These and other objects, features, and advantages of the invention will become apparent upon reading the specification when taken in conjunction with the accompanying drawings, wherein like characters of reference designate corresponding parts throughout the several views.

DETAILED DESCRIPTION

Figure 1:
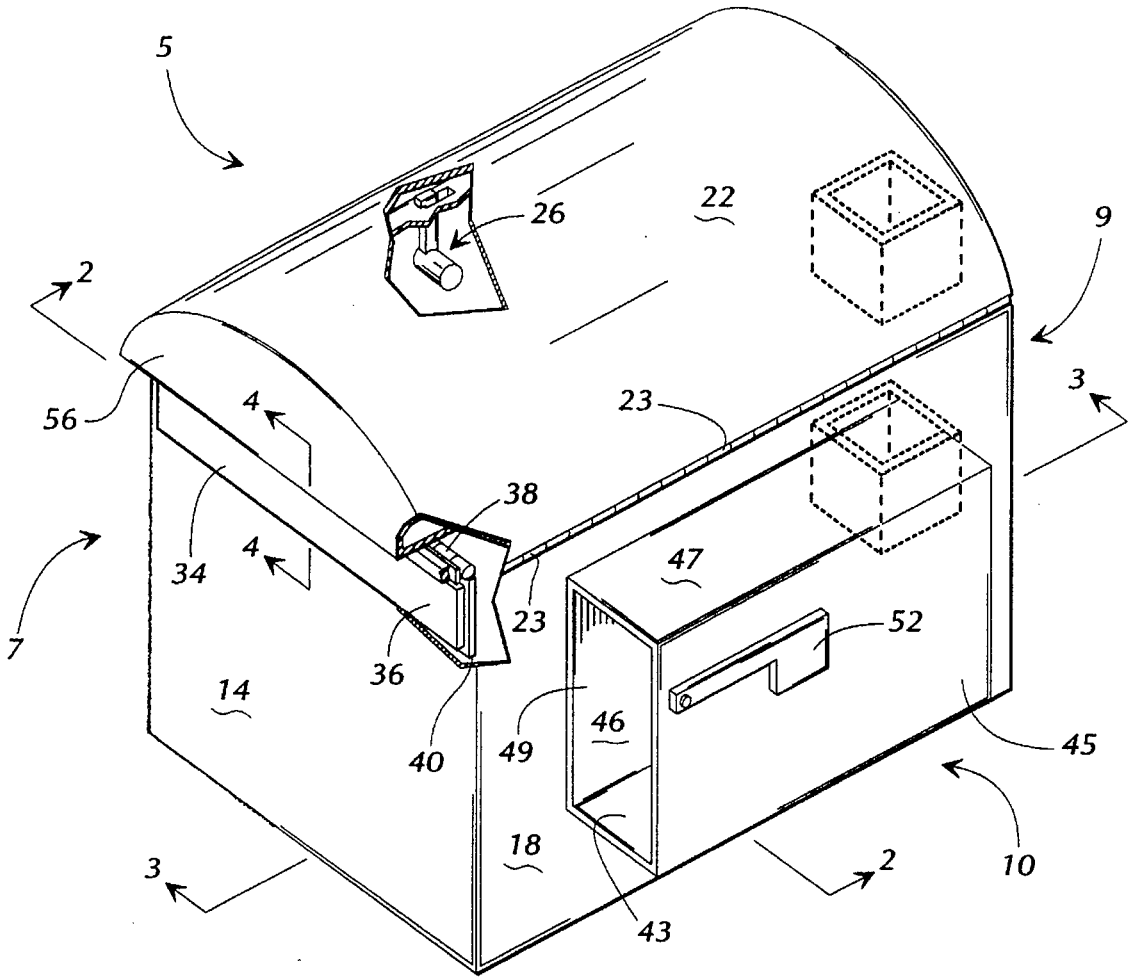
FIG. 1 is a perspective view of a preferred embodiment of a top opening locking mailbox.
Figure 2:
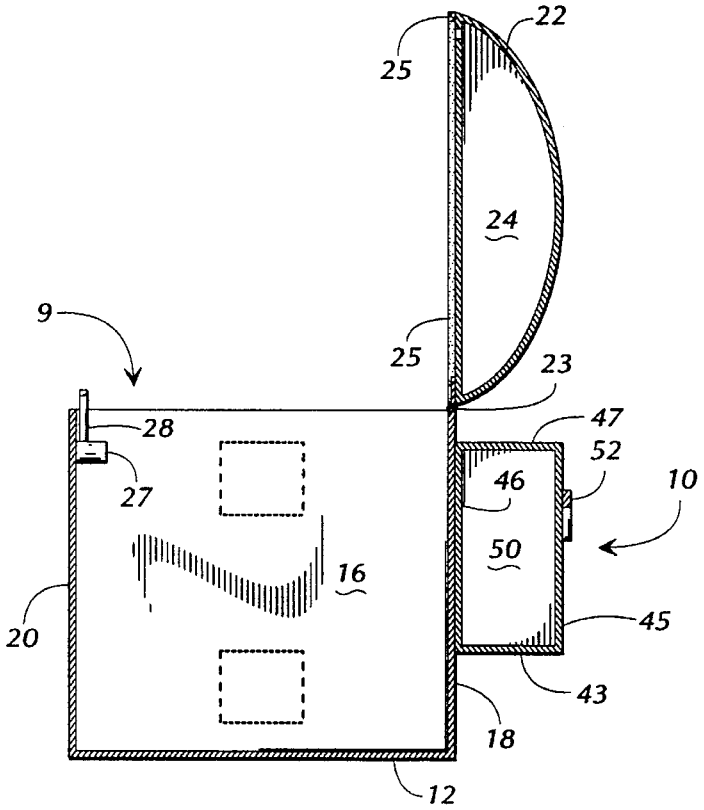
FIG. 2 is a front elevational cross-section along line 2—2 of FIG. 1.
Figure 3:
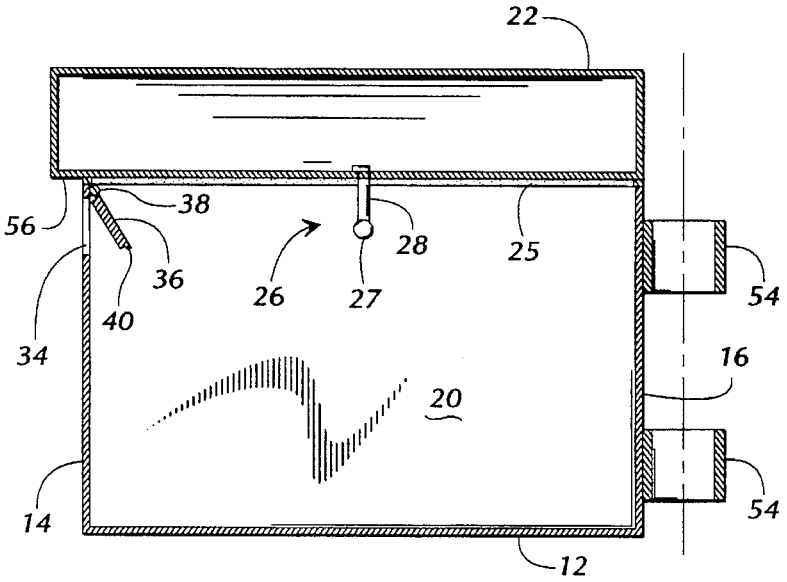
FIG. 3 is a side elevational cross-section along line 3—3 of FIG. 1.

Referring now in detail to the drawings, in which like reference numerals indicate like parts throughout the several views, numeral 5 of FIGS. 1 to 3 illustrates a preferred embodiment of the top opening locking mailbox. Mailbox 5 has a housing 7, housing 7 having a first compartment 9 defined within the housing, and a second compartment 10 mounted on the exterior of housing 7.

As best in shown FIGS. 1 to 3, housing 7 has a generally rectangular and horizontal bottom 12, an upstanding front panel 14, a spaced apart, parallel, and upstanding rear panel 16, and a pair of spaced apart and parallel side panels 18 and 20. Front panel 14, rear panel 16, and side panels 18 and 20 are connected to bottom panel 12 along their common horizontal edges. Front panel 14, rear panel 16, and side panels 18 and 20 are also connected to each other along their common vertical edges for forming a generally rectangular housing having a closed bottom and closed sides with an open top.

Referring now to FIG. 1, the open top of housing 7 is enclosed by a top panel 22. Although top panel 22 is illustrated here in arcuate configuration, top panel 22 could be a flat plate or any other desired architectural shape so long as top panel 22 acts to enclose first compartment 9 within housing 7. Top panel 22 is pivotally supported along the edge of one of side panels 18 or 20 through the use of a hinge 23. Hinge 23 can be any conventional hinge structure although it is anticipated that hinge 23 will most closely resemble a piano type hinge that will run along the length of the top edge of one of side panels 18 or 20, as well as along the corresponding length of top panel 22 supported on housing 7. Also, and again due to its arcuate configuration, top panel 22 has a hollow inner portion 24, comparable to a scooped out portion, in order to save weight and construction costs in the manufacture of mailbox 5.

An elongated and continuous seal 25 is fastened or formed along the bottom edge of top panel 22 that will rest along the top horizontal edges of from panel 14, rear panel 15, and side panels 18 and 20. This feature is best shown in FIGS. 2 and 3, it being understood by those skilled in the art that when top panel 22 is closed down onto housing 7, in its closed position (FIGS. 1 and 3), seal 25, positioned along the bottom of top panel 22, traces along the perimeter of top panel 22 and seals top panel 22 down onto housing 7 so that water cannot enter the mailbox, and for also serving as a deterrent against tampering or theft and vandalism of the mailbox or the mail contained therein. Seal 25 is constructed of any conventional seal material adapted for use in an outdoor environment, to include rubber or any of the synthetic plastic or rubber materials commonly used to make gaskets or seals for outdoor environments.

As best shown in FIGS. 1 and 3, a locking mechanism 26 is mounted on one of the side panels 18 or 20 opposite the side on which hinge 23 is mounted. The purpose of locking mechanism 26 is to lock top panel 22 into a closed position (FIG. 1, FIG. 3) so that mail and other items delivered in the mail, or other deliveries placed in the mailbox, will be securely held within mailbox 5. As shown in FIGS. 1 and 3, locking mechanism 26 is constructed of a cylinder lock 27, and an arm 28 which moves through an approximate 90° arc and received within top panel 22 for locking top panel 22 in closed position on top of housing 7. Top panel 22 is shown in its open position in FIG. 2, where mail or other items delivered and placed into mailbox 5 can be removed by any authorized person who has the key to actuate locking mechanism 26.

Figure 5:
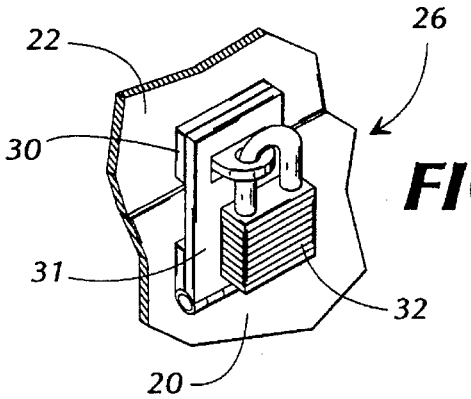
FIG. 5 is a partial perspective view of an alternate locking mechanism used to lock the mailbox of FIG. 1.

Referring now to FIG. 5, in an alternate embodiment of locking mechanism 26, a hasp 30 and a matching portion of the hasp 31 are mounted on one of side panels 18 or 20, and top panel 22, respectively, on the side of housing 7 opposite hinge 23. A removable key or combination padlock 32 will be placed through hasps 30 and 31 in order to lock the mailbox shut.

Turning now to FIGS. 1 and 3, housing 7 has an elongated mail slot 34 defined in front panel 14. Mail slot 34 extends the width of front panel 14. It is anticipated that mailbox 5 will be configured to be in the range of 11" to 12" wide, and although mail slot 34 is shown here extending the full width of the mailbox, this is not an absolute requirement, mail slot 34 can be sized differently if so desired. Also, and as best shown in FIGS. 1 and 3, mail slot 34 is defined along the top of front panel 14, and will be adjacent top panel 22 when the top panel is closed on housing 7.

Still referring to FIGS. 1 and 3, an elongated flap 36 is pivotally supported on housing 7 so that the flap closes down on and into mail slot 34. Flap 36 is pivotally supported on housing 7 through the use of hinge 38, hinge 38 being a conventional hinge, although it is again anticipated here that hinge 38 will be an elongated piano hinge as is hinge 23. If, however, front panel 14 only extends from bottom panel 12 up to where mail slot 34 is defined in housing 7, it is possible that an elongated metal rod (not illustrated) extending between side panel 18 and 20 could serve as the support member about which hinge 38 would pivot when mail flap 36 is opened and closed.

Figure 4:
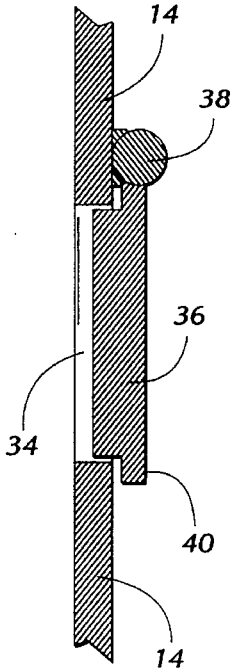
FIG. 4 is a partial side cross-section along line 4—4 of FIG. 1.

Referring now to FIGS. 3 and 4, flap 36 has a bottom lip 40 which is shaped and contoured so that flap 36 will fit inside of slot 34, lip 40 acting to seal flap 36 on slot 34. As constructed, flap 36 is sized and shaped to be yieldably urged open as mail and deliveries are passed through mail slot 34 downward into first compartment 9 formed within housing 7. Flap 36 is biased in its closed position, illustrated in FIG. 1, by the weight of flap 36 and its being supported on its top edge by hinge 38. Thus, as mail and deliveries are passed through mail slot 34, it will physically push flap 36 backwards, as shown by the directional arrow in FIG. 3, until such time as the mail is passed through slot 34, whereupon flap 36 will return itself to a closed position (FIG. 1) on mail slot 34.

Although it has not been illustrated here, it is possible that flap 36 could be biased by a spring or other tensioning means to urge flap 36 into its closed position on mail slot 34, but yet allow flap 36 to be yieldably urged open with the passage of mail through mail slot 34 into first compartment 9.

Referring now to FIGS. 1 and 2, second compartment 10 is formed as an elongated tubular body mounted externally on housing 7 separately from first compartment 9. The function of second compartment 10 is to serve as device for holding outgoing mail and parcels to be picked up by the letter carriers as they make their daily rounds to deliver mail. Access to first compartment 9 cannot be gained through second compartment 10. Second compartment 10 has a generally horizontal bottom shelf 43 for holding outgoing mail, shelf 43 being connected here to generally vertical side portions 45 and 46 along their common horizontal edges, both side portions also being connected to a generally horizontal top portion 47 along their common edges. Second compartment 10 is then mounted on one of side panels 18 or 20. In this instance, second compartment 10 is fastened to side panel 18.

Although second compartment 10 is shown as being on the side of mailbox 5 on which hinge 23 of top panel 22 is located, it is anticipated that second compartment 10 can be mounted on either one of the side panels 18 or 20, or can be mounted underneath bottom panel 12, or, if top panel 22 is a flat rectangular plate, second compartment 10 can be mounted on top of top panel 22.

As best shown in FIG. 1, second compartment 10 has an open end 49 on the side of the compartment facing in the direction of front panel 14, and a closed end 50, so that second compartment 10 is an elongated tubular body having one open end in which mail is placed for pick up. It is anticipated, however, that second compartment 10 could have two open ends, open end 49 and closed end 50 being open, so that outgoing mail could be placed into second compartment 10 from the rear of mailbox 5 extending toward front panel 14, without the need to walk around the mailbox and place the mail into second compartment 10 from the street along which the mailbox is positioned.

As with conventional mailboxes, mailbox 5 will have a mail flag 52 (FIG. 1) pivotally supported thereon for signaling when mail is present for pickup by the letter carrier. In addition, mailbox 5 will have a pair of post support brackets 54 (FIG. 3) located along a common axial line as indicated in FIG. 3, so that post support brackets 54 can be fitted down and over a conventional support post mounted in the ground and extending upward for supporting the mailbox at the required height by the U.S. Postmaster for street side deliveries.

With the exception of hinge 23, seal 25, locking mechanism 26, hinge 38 and mail flag 52, top opening locking mailbox 5 can be constructed of any conventional material, to include galvanized sheet metal or other metal materials currently used for the production of mailboxes, as well as any durable and rigid plastic which will offer increased durability for weather resistance and to resist vandalism and tampering with mailbox. It is anticipated that mailbox 5 will be constructed of a rigid and durable plastic material, however, which offers the advantages of thick cross-section and strength with light weight combined with case of manufacture and installation. Post support brackets 54 will be integrally formed as a part of mailbox 5, or in the alternative can be riveted, bolted, or screwed into rear panel 16 of mailbox 5. Hinge 23 and hinge 38 are conventional hinges adapted for use in an outdoor environment, and will either be riveted, screwed, or bolted into and along the top edge of side panels 18 or 20, and the corresponding edge of top panel 22. It is also possible that hinges 23 and 38 could be integrally cast or molded into the plastic material forming housing 7 and top panel 22. Also, although not illustrated, top panel 22 could open along the top edge of front panel 14 or rear panel 16 if so desired. Flap 36 is constructed of the same material out of which housing 7 is constructed, or if so desired for architectural or appearance purposes, flap 36 could be constructed of any decorative metal such as brass or bronze, for example.

As best shown in FIGS. 1 and 3, a feature of mailbox 5 is protective lip 56 formed as a part of top panel 22, along that portion of top panel 22 which extends beyond front panel 14. Protective lip 56 is provided for sheltering mail slot 34 from the elements much as an awning shelters a window from rain and sun. Protective lip 56 is formed as a part of top panel 22.

While a preferred embodiment of the invention has been disclosed in the foregoing specification, it is understood by those skilled in the art that variations and modifications thereof can be made without departing from the spirit and scope of the invention, as set forth in the following claims.

I claim:

1. A top opening locking mailbox for receiving mail and other deliveries, to include newspapers and magazines, in a weather and theft resistant enclosure, comprising:

a generally rectangular housing, the housing having a closed bottom, closed sides, and an open top;

a top panel supported on the housing, said panel being spaced apart from the closed bottom of the housing and being movable from an open position into a closed position;

locking means disposed on said housing, wherein said locking means lock said top panel on the housing in said panel's closed position for enclosing a first compartment thus formed in the housing;

an elongated mail slot defined in the housing for passing mail and deliveries into the first compartment;

an elongated flap mounted on said housing in relationship to said slot, said flap being pivotally supported on the inside of the housing in overlapping fashion on the mail slot and being sized and shaped to close the mail slot;

a second compartment mounted on the housing and having an opening defined therein for holding outgoing mail;

whereby outgoing mail is placed in the second compartment for pickup, and mail and deliveries are passed through the mail slot into the first compartment and held therein until the top panel of the mailbox is unlocked and the contents of the compartment removed.

2. The mailbox of claim 1, wherein said housing comprises:

a generally horizontal bottom panel;

a generally upright front panel;

a generally upright rear panel spaced apart from said front panel; and two generally upstanding side panels spaced apart from each other;

wherein the front, side, and rear panels are joined to the bottom panel along their common horizontal edges, and where the front, side, and rear panels are joined to one another along their common vertical edges for forming said housing.

3. The mailbox of claim 2, wherein said mail slot is positioned in the front panel parallel to the closed bottom.

4. The mailbox of claim 2, wherein said mail slot is positioned in the front panel adjacent the top panel when the top panel is in its closed position.

5. The mailbox of claim 3, wherein said mail slot extends the width of the front panel.

6. The mailbox of claim 2, wherein said top panel comprises seal means for sealing the top panel onto the upper horizontal edges of the front, side, and rear walls of the housing.

7. The mailbox of claim 2, wherein said top panel is pivotally fastened to said housing along the top edge of one of said side panels.

8. The mailbox of claim 2, wherein said top panel comprises a protective lip extending beyond the front panel of the housing for protecting said mail slot from the elements.

9. The mailbox of claim 1, wherein said locking means comprises cylinder lock means disposed on the housing for locking the top panel in its closed position on the housing.

10. The mailbox of claim 1, wherein said locking means comprises a hasp and a padlock removably received thereon.

11. The mailbox of claim 1, wherein said flap is biased in a closed position on the mail slot, said flap being sized and shaped to be yieldably urged open as mail and deliveries are passed through the mail slot into the first compartment.

12. The mailbox of claim 1, wherein the second compartment comprises an elongated tubular body having an open end facing in the same direction as said front panel.

13. The mailbox of claim 1, further comprising at least one post support bracket mounted on the exterior of the housing for supporting the mailbox on a support post extending upward from the ground.

14. A top opening locking mailbox for receiving mail and other deliveries, to include newspapers and magazines, in a weather and theft resistant enclosure, comprising:

a generally rectangular housing, the housing having a generally horizontal bottom panel, a generally upright front panel and a generally upright rear panel spaced apart from one another, and two generally upstanding side panels spaced apart from each other, wherein the front, side, and rear panels are joined to the bottom panel along their common horizontal edges, and where the front, side, and rear panels are joined to one another along their common vertical edges forming a housing with an open top;

a generally rectangular top panel, said panel being pivotally supported on the housing, the top panel being spaced apart from the bottom panel and being movable from an open position into a closed position;

locking means for locking the top panel on the housing in said panel's closed position for enclosing a first compartment thus formed in the housing;

an elongated mail slot defined in the front panel, said mail slot extending the width of the front panel;

an elongated flap sized and shaped to cover the mail slot, the flap being pivotally supported on the inside of the housing in overlapping fashion on the mail slot;

a second compartment mounted on the housing and having an opening defined therein for holding outgoing mail;

whereby outgoing mail is placed in the second compartment for pickup, and mail and deliveries are passed through the mail slot into the first compartment and held therein until the top panel of the mailbox is unlocked and the contents of the compartment removed.

15. The mailbox of claim 14, wherein said flap is biased in a closed position on said mail slot, the flap being sized and shaped to be yieldably urged open as mail and deliveries are passed through the mail slot into the first compartment.

16. The mailbox of claim 14, wherein said second compartment comprises an elongated tubular body having an open end facing in the same direction as said front panel.

17. The mailbox of claim 14, wherein said top panel comprises seal means for sealing the top panel onto the upper horizontal edges of the front, side, and rear walls of the housing.

18. The mailbox of claim 14, wherein said top panel comprises a protective lip extending beyond the front panel of the housing for protecting said mail slot from the elements.

19. The mailbox of claim 14, further comprising at least one post support bracket mounted on the exterior of the housing for supporting the mailbox on a support post extending upward from the ground.

* * * * *